US005690439A

United States Patent [19]

Sasaki et al.

[11] Patent Number: 5,690,439

[45] Date of Patent: Nov. 25, 1997

[54] THERMAL TRANSFER PRINTING APPARATUS

[75] Inventors: Naotaka Sasaki; Shunichi Kawamata; Kenji Sugaya, all of Gunma, Japan

[73] Assignee: Japan Servo Co., Ltd., Tokyo, Japan

[21] Appl. No.: 571,438

[22] Filed: Dec. 13, 1995

[30] Foreign Application Priority Data

Dec. 15, 1994 [JP] Japan ..... 6-332898
Dec. 15, 1994 [JP] Japan ..... 6-332899

[51] Int. Cl.[6] ..... B41J 35/22

[52] U.S. Cl. ..... 400/206.2; 400/206

[58] Field of Search ..... 400/194, 196, 400/196.1, 206, 206.2, 207, 208, 208.1; 347/214

[56] References Cited

U.S. PATENT DOCUMENTS 4,569,608 2/1986 Watanabe ..... 400/208
4,778,290 10/1988 Costa et al. ..... 400/206
4,898,484 2/1990 Aoyagi et al. ..... 400/120
5,030,969 7/1991 Kaneko et al. ..... 346/76
5,352,048 10/1994 Mizoguchi et al. ..... 400/208
5,540,509 7/1996 Matsuzawa et al. ..... 400/208

FOREIGN PATENT DOCUMENTS 2-155678 6/1990 Japan ..... 400/206

*Primary Examiner*—David A. Wiecking
*Attorney, Agent, or Firm*—Nilles & Nilles

[57] ABSTRACT

A thermal transfer printing apparatus has an improved ink sheet interchanging device. A fusion type or sublimation type thermal transfer printing using a combination of many kinds of ink sheets can be carried out by a single printing apparatus. A desired ink sheet cassette is selected from a plurality of ink sheet cassettes each having an ink sheet, and moved to a printing portion. A plurality of ink sheet cassettes are stacked in a stock portion arranged in the up-stream side or the down-stream side of the cassette transferring direction. A plurality of ink sheet cassettes are mounted on a rotary plate, and a desired ink sheet cassette is transferred to the printing portion by rotating the rotary plate.

6 Claims, 9 Drawing Sheets

THERMAL TRANSFER PRINTING APPARATUS

BACKGROUND OF THE INVENTION

1. Field of the Invention

This invention relates to a thermal transfer printing apparatus, and more particularly, relates to a thermal transfer printing apparatus having an improved ink sheet interchanging drive for use in a fusion type or sublimation type thermal transfer printing using a combination of many kinds of ink sheets, which is carried out by a single printing apparatus, wherein a desired ink sheet cassette is 1) selected from a plurality of ink sheet cassettes each having an ink sheet and 2) moved to a printing portion.

2. Description of the Prior Art

As a conventional thermal transfer printing apparatus with a plurality of interchangeable ink sheets, (1) the Japanese Patent Laid-Open Publication No. 155678/1990, (2) U.S. Pat. No. 4,569,608, (3) U.S. Pat. No. 4,898,484 and (4) U.S. Pat. No. 5,030,969 are disclosed. The ink sheet interchangeable systems of the thermal transfer printing apparatus in the prior art will be explained as following.

(1) In the system of the thermal transfer printing apparatus disclosed in the Japanese Patent Laid-Open Publication No. 155678/1990 (the Japanese patent), supply rolls and take-up rolls for a plurality of mono-color ink sheets are stored in a sheet stock portion arranged at an up-stream or down-stream side of the roll forwarding direction with respect to a recording portion composed of a thermal head and a platen roller as shown in FIG. 1 of said publication, so that an ink sheet of required color and a holding portion for holding a take-up roll for said ink sheet of said required color are held, that the ink sheet is spread over the printing portion for printing and that the ink sheet take-up roll is restored to the sheet stock portion after the printing.

In the ink sheet selection system, a required ink sheet is picked up by the sheet selection device by moving the ink sheet stock portion in the vertical direction.

(2) In the printing apparatus of said U.S. Pat No. 4,569,608 (the '608 patent), ink sheet cassettes each including an ink sheet having ink regions of yellow, magnet, cyan and black arranged side by side each of which regions corresponds substantially to the printing area are stored in a cassette holding unit so that the take-up axis of the ink sheet is in parallel to the printing portion, the cassette holding unit being arranged beside the recording portion composed of a thermal head and a platen roller. The printing is carried out by sliding and moving a desired ink sheet cassette in the direction in parallel to the line of heating elements in the thermal head toward the printing portion. The ink sheet cassette moved to the printing portion can be restored in said cassette holding unit at need.

(3) In the thermal transfer printer of U.S. Pat No. 4,898,484 (the '484 patent), a plurality of ink sheet cassettes are stored in a drum, and the take-up roll of the ink sheet stored is connected to a cassette plate held rotatably by the drum shaft. Further, the ink sheet cassette is moved so that the supply roll side of the ink sheet is transferred to the recording portion while rotating the cassette plate around the drum shaft, and the ink sheet cassette is restored in the drum after the printing. Further, in the modified embodiment, a plurality of ink sheet cassettes are fixed to an endless belt over the printing portion, and one ink sheet cassette including a desired ink sheet therein is moved to the printing portion by driving the belt by a motor. Furthermore, ink sheet cassettes are stacked in a stocker arranged in the down-stream side of the forwarding direction of the ink sheet cassette with respect to the printing portion, and said take-up side of the ink sheet is taken out through the printing portion to spread the ink sheet by moving the stocker in the vertical direction as said prior art (1).

(4) In the thermal transfer printing apparatus of said U.S. Pat. No. 5,030,969 (the '969 Patent), the holding manner of the holding shaft for holding the ink sheet similar to that of said prior art (1) is improved so as to simplify in motion mechanism for the reception and to circulate along a circle the ink sheet supply roll and the take-up roll of the ink sheet stock portion. As in the Japanese patent, a predetermined printing is carried out by moving the take-up roll of the ink sheet of desired color, and the ink sheet take-up roll is restored in the sheet stock portion.

In the thermal transfer printing apparatus disclosed in the Japanese patent, an ink sheet is selected by moving up and down the ink sheet stock portion including a plurality of ink sheets, so that a space for the movement of ink sheet stock portion in the vertical direction is necessary, thereby causing the apparatus to be large. Further, the ink sheet of desired color is spread over the recording portion while holding the ink sheet and the holding portion of the ink sheet take-up roll, so that the driving power of the ink sheet selecting device becomes large and an expensive high power driving source is required.

Furthermore, it is difficult to handle the ink sheet when the ink sheet is loaded on the ink sheet stock portion.

In the case of the prior art of the '608 patent, a plurality of ink sheet cassettes each including an ink sheet are stored in the cassette holding unit arranged beside the recording portion composed of the thermal head and the platen roller, so that the take-up axis of the ink sheet is in parallel to the recording portion. The ink sheet cassette is interchanged by moving the cassette in parallel to the recording portion to reduce the space in the vertical direction. However, as the cassette holding unit is arranged beside the printing portion, a printing apparatus having a large printing width becomes large in width.

In the case of the prior art of the '484 patent, a plurality of take-up rolls of the ink sheets stored in the drum are connected to the cassette plate rotatably supported by the drum shaft. Accordingly, the mechanism becomes complicated and the loading of the ink sheet becomes difficult. Further, in the disclosed ink sheet cassette moving system, a plurality of ink sheet cassettes are fixed to the endless belt arranged over the printing portion, and the ink sheet cassette including desired ink sheet therein is moved to the printing portion by driving the belt by the motor. Thus, the number of the ink sheet cassettes moved at the same time becomes large, and a high power driving source is required for the drive of the belt. Further, in the system wherein the ink sheet cassettes each divided into the supply roll side and the take-up side are stacked in the stocker arranged in the down stream side of the forwarding direction of the ink sheet with respect to the printing portion, the handling of the ink sheet is difficult as in the Japanese patent, and the apparatus becomes large in size, because the ink sheet stock portion is moved up and down as the Japanese patent.

The invention disclosed in the the '969 patent is invented by the inventor of the invention disclosed in the Japanese patent. In the '969 patent, the defect in the Japanese patent that the high driving power for the ink sheet selecting mechanism is required is deleted. However, the other defects are not deleted.

SUMMARY OF THE INVENTION

An object of the present invention is to provide a thermal transfer printing apparatus which eliminates the above defects.

Another object of the present invention is to provide a thermal transfer printing apparatus which is inexpensive and small in size, in which the ink sheet can be handled easily, and in which a plurality of ink sheets can be interchanged with small power.

Yet another object of the present invention is to provide a thermal transfer printing apparatus characterized by comprising a thermal head including a plurality of heating elements, a platen roller to which the thermal head is urged selectively, a printing portion at which an ink on the ink sheet is printed by a thermal energy produced when the heating elements are conducted onto recording paper inserted between the thermal head and the platen roller, a first stock portion for storing therein a first ink sheet cassette including a first ink sheet, a second stock portion for storing therein a second ink sheet cassette including a second ink sheet, and means for transferring to the printing portion selectively one of the first ink sheet cassette and the second ink sheet cassette to carry out the thermal transfer printing.

A further object of the present invention is to provide a thermal transfer printing apparatus characterized by comprising a thermal head including a plurality of heating elements, a platen roller to which the thermal head is urged selectively, a printing portion at which an ink on the ink sheet is printed by a thermal energy produced when the heating elements are conducted on a recording paper inserted between the thermal head and the platen roller, a first stock portion for storing therein a first ink sheet cassette including a first ink sheet, a second stock portion for storing therein a second ink sheet cassette including a second ink sheet, and means for transferring to the printing portion selectively one of the first ink sheet cassette and the second ink sheet cassette to carry out the thermal transfer printing, the first and second ink sheet cassettes are arranged at one of up-stream side and down-stream side of the ink sheet cassette forwarding direction with respect to the printing portion and stacked with each other.

A still further object of the present invention is to provide a thermal transfer printing apparatus characterized by comprising a thermal head including a plurality of heating elements, a platen roller to which the thermal head is urged selectively, a printing portion at which an ink on the ink sheet is printed by a thermal energy produced when the heating elements are conducted on a recording paper inserted between the thermal head and the platen roller, a plurality of ink sheet cassettes each including an ink sheet, a rotating plate which can be rotated at a predetermined angular position, means for mounting the plurality of ink sheet cassettes normal to the rotating plate and transferring to the printing portion selectively one ink sheet cassette including desired ink sheet by rotating and positioning said rotating plate to carry out the thermal transfer printing.

According to the thermal transfer printing apparatus of the present invention, the working ability of the loading of the ink sheet can be enhanced, the size can be made small, and the power of the driving source for forwarding the ink sheet cassette can be minimized, because the ink sheet cassette is easy to handle and can be stored in the stock portion arranged at the up-stream side or the down-stream side of the cassette forwarding direction with respect to the printing portion, and only the ink sheet cassette including a desired ink sheet can be transferred to the printing portion.

Further, according to the thermal transfer printing apparatus of the present invention, a high speed operation of the automatic selection of the ink sheet cassettes can be attained, because a plurality of ink sheet cassettes which are easy to handle can be mounted normally to the rotating plate, and only the ink sheet cassette including a desired ink sheet can be transferred to the printing portion selectively by rotating and positioning the rotating plate for carrying out the thermal transfer printing.

The above and other objects as well as advantageous features of the invention will become apparent from a consideration of the following description of the preferred embodiments taken in conjunction with the appended claims, and the accompanying drawings.

DESCRIPTION OF THE PREFERRED EMBODIMENTS

An embodiment of the present invention will be explained with reference to FIGS. 1–9.

Figure 9:
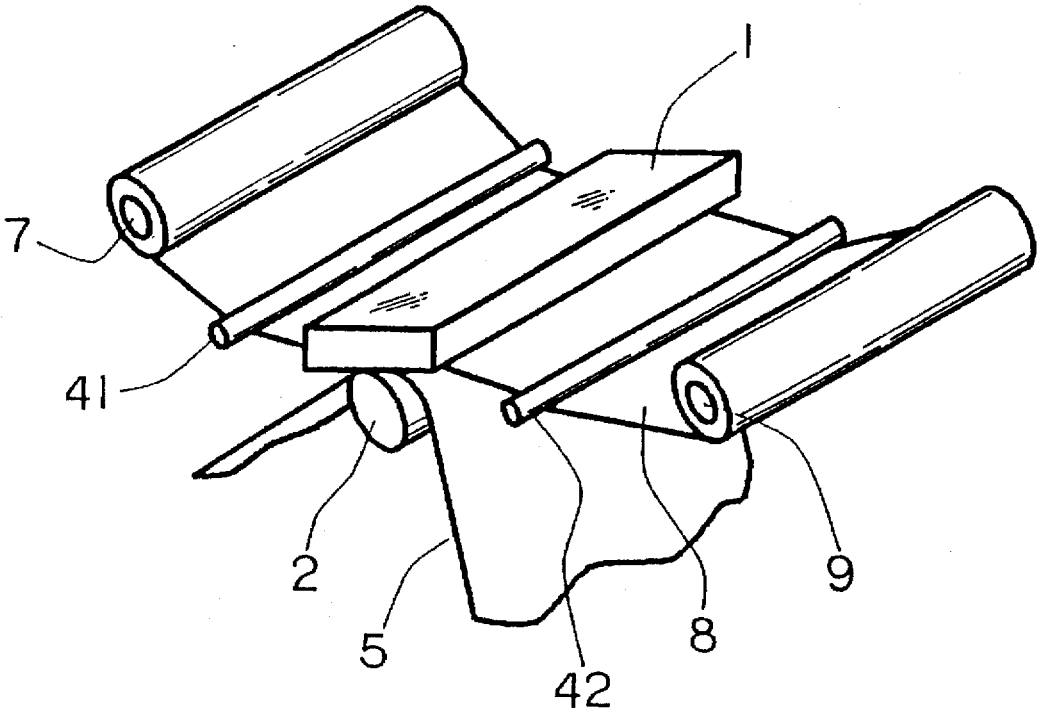
FIG. 9 is a schematic perspective view of the basic construction of the thermal transfer printing apparatus.

FIG. 9 is a schematic perspective view of the basic construction of the thermal transfer printing apparatus. As shown in FIG. 9, a recording paper 5 and an ink sheet 8 are passed between 1) a thermal head 1 having a plurality of linear heating elements extending along the printing width of the head and 2) a platen roller 2 rotatable in the clockwise direction and the counter-clockwise direction according to a predetermined sequence so that the ink layer of the ink sheet 8 is deposited on the recording paper 5. The wrinkles of the ink sheet 8 are pressed out by tension bars 41 and 42. The ink on the ink sheet 8 is printed on the recording paper 5 by a heat energy generated by the heating elements selectively while rotating the platen roller 2 in the recording paper transfer direction and pressing the thermal head 1 against the platen roller 2 according to the command from a control portion (not shown).

Figure 7:
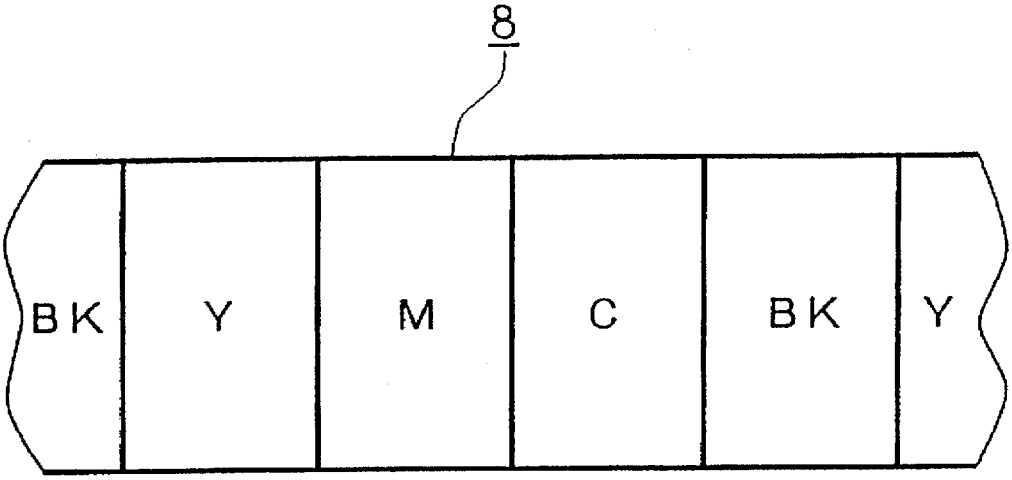
FIG. 7 is a view of a multiple-color ink sheet for use in the thermal transfer printing apparatus.

The ink sheet 8 for use in the thermal transfer printing has ink portions of yellow Y, magenta M, Cyan C and black BK arranged side by side, as shown in FIG. 7. A final color printing can be obtained by superposing the inks of different colors by moving the recording paper 5 reciprocally. There are two kinds of ink layers of the ink sheet 8. One is for the fusion type thermal transfer printing of which the running cost is low because plain paper can be used, but the image quality is not so good. The other is for the sublimation type thermal transfer printing of which the running cost is high because a special recording paper is required, but the image quality is good.

Accordingly, in consideration of the running cost, the printing of the test is carried out by using an ink sheet for the fusion type thermal transfer printing and plain paper, and the final finishing printing is carried out by one thermal transfer printing apparatus by using an ink sheet for the sublimation type thermal transfer printing and the special paper. Further, an ink sheet of mono-color, for precoat, postcoat or the like other than the multiple-color ribbon shown in FIG. 7 can be used. If the combination of these ink sheets are used in one thermal transfer printing apparatus, the cost of the ink sheets can be reduced, and the profit of the thermal transfer printing apparatus using a plurality of ink sheets can be increased.

Figure 1:
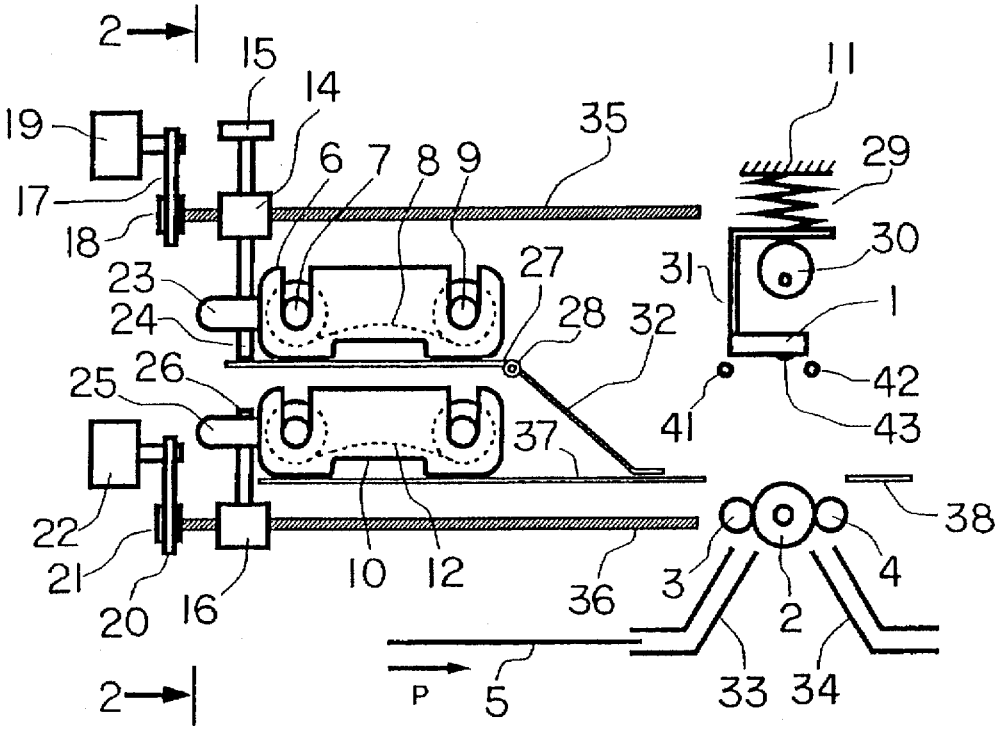
FIG. 1 is a schematic view of a thermal transfer printing apparatus of the present invention.

As shown in FIG. 1, the thermal head 1 having linear heating elements 48 arranged on the entire printing area is fixed on a head supporting arm 31, and a portion of the head supporting arm 31 is urged by an end of a head spring 29 against a head cam 30 supported eccentrically. Accordingly, the thermal head 1 is moved up and down by rotating cam 80. Further, the other end of the head spring 29 is supported by a head supporting member 11 which can be moved up and down independently, so that a large space can be formed under the thermal head 1 by combining movement of the member 11 with the movement of the thermal head 1 due to the rotation of the cam 30.

Figure 8:
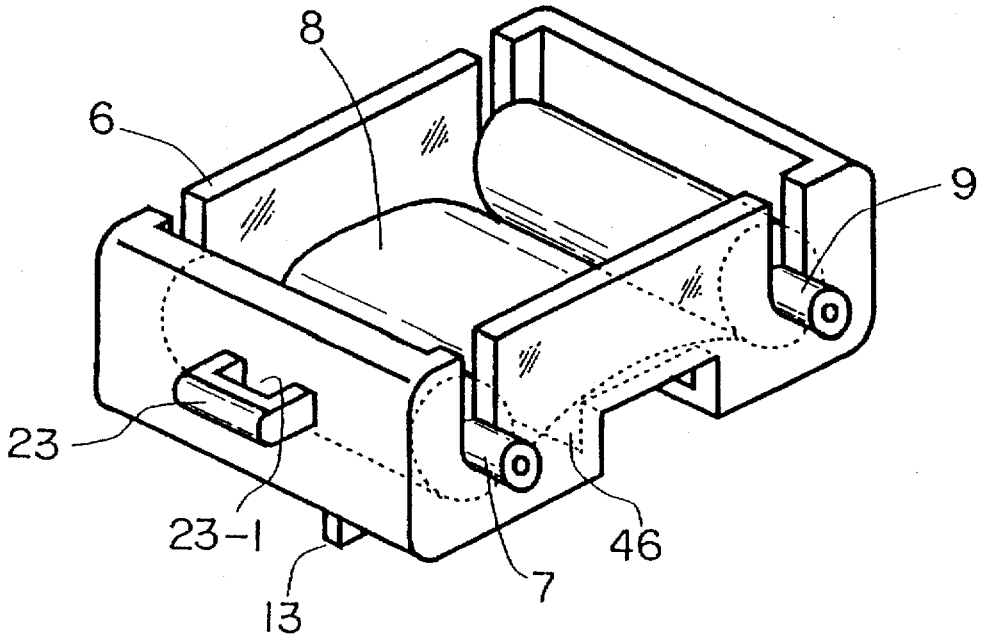
FIG. 8 is a perspective view of an ink sheet cassette for use in the thermal transfer printing apparatus.

A first ink sheet cassette 6 for storing therein the ink sheet 8 is shown in FIG. 8. One end of the ink sheet 8 is wound around a supply side core 7, and the other end is wound around a take-up side core 9. One end of each of said cores 7 and 9 is projected from the first ink sheet cassette 6 and connected to an ink sheet transfer mechanism (not shown) of the printing apparatus. As the ink sheet 8 is stored in the first ink sheet cassette 6, when the ink sheet 8 is to be interchanged the first ink sheet cassette 6 is taken out of the printing apparatus, so that the interchanging operation can be carried out easily without touching the human hand with the ink sheet 8. A handle 23 is provided on one outer side of the first ink sheet cassette 6. A through hold 23-1 for a finger 24 transferred by a first carrige 14 is formed inside of handle 28. A window 46 through which the ink sheet 8 is moved toward the printing portion by the thermal head 1 is formed on the bottom portion of the first ink sheet cassette 6 as shown in FIG. 8. Further, a small guide projection 13 for guiding linealy the first ink sheet cassette 6 in connection with a guide groove formed on a first cassette guide plate 27 is provided on a portion of said bottom portion as shown in FIG. 8. A second ink sheet cassette 10 which is similar in construction to the first ink sheet cassette 6 is provided.

As shown in FIG. 1, a first stock portion is provided. In the first stock portion, the handle 28 of the first ink sheet cassette 6 including the 20 ink sheet 8 is engaged with the finger 24 transferred by the first carriagae 14 arrangaed on the up-stream side of the cassette forwarding direction shown by an arrow P with respect to the printing portion which is composed of the thermal head 1 and the platen roller 2. A second stock portion is formed. In the stock portion, a handle 25 of a second ink sheet cassette 10 including an ink sheet 12 is engaged with a finger 26 of a second carriage 16. The first carriage 14 and the second carriage 16 can be moved by the rotations of lead screws 35 and 36, respectively. When the printing apparatus is not operated, the ink sheet cassettes are positioned and held in the first and second stock portion as shown in FIG. 1.

The lead screw 35 is rotated by a carriage motor 19 through a rotary shaft of the carriage motor 19, a timing belt 17 and a timing pully 18 with teeth fixed on one end of said lead screw 35. When the lead screw 35 is rotated, the first carriage 14 is moved linearly so that the first ink sheet cassette 6 is moved reciprocally according to the rotary direction of the lead screw 35 between the first stock portion and the printing portion. Similarly, the lead screw 36 is rotated by a carriage motor 22. According to the rotary direction of the lead screw 36, the second carriage 16 is moved linearly so that the second ink sheet cassette 10 is moved reciprocally between the second stock prtion and the printing portion.

Figure 2:
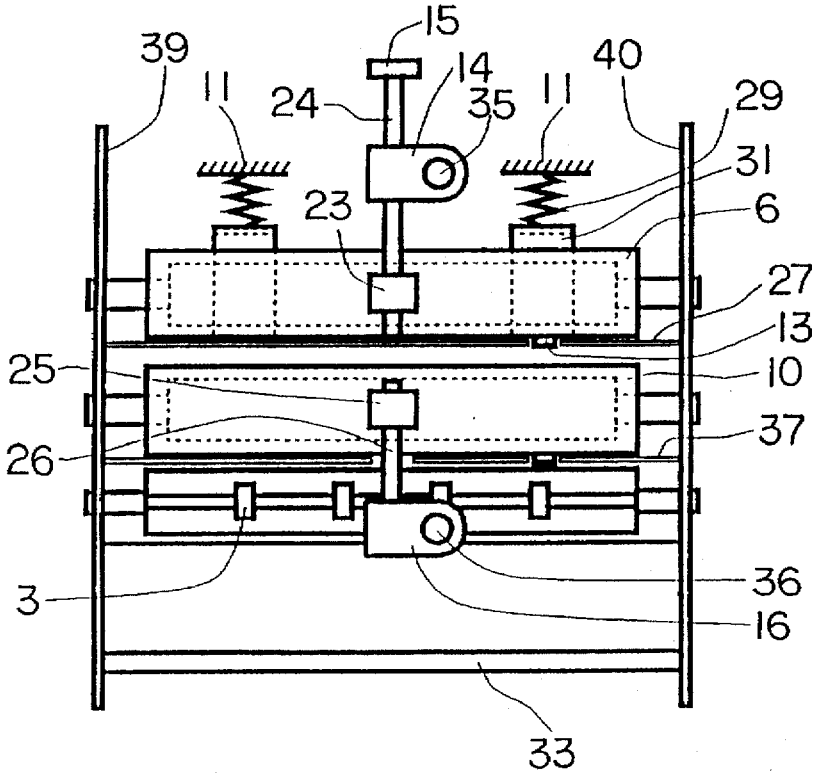
FIG. 2 is a view taken along a line 2—2 in FIG. 1.

FIG. 2 is a view of the thermal transfer printing apparatus taken along a line 2—2 in FIG. 1. Main parts of the printing portion are inserted between side plates 39 and 40. A portion of one side plate 40 is formed with a door so as to allow removal and insertion of the first ink sheet cassette 6 and the second ink sheet cassette 10. The finger 24 engaging with the handle 23 of the first ink sheet cassette 6 is passed through the first carriage 14. The tip end of the finger 24 is lowered by its own weight and contacted slidably on the first cassette guide plate 27 of the first stocker. The first ink sheet cassette 6 is moved toward the printing portion along a predetermined path by the guide of the guide projection 13 formed on the bottom surface of the first ink sheet cassette 6 and a groove formed on the first cassette guide plate 27.

The finger 26 fixed on the second carriage 16 is engaged with the handle 25 of the second ink sheet cassette 10, and the second ink sheet cassette 10 is moved by the movement of the second carriage 16. Further, a groove is formed on a second cassette guide plate 37 along the moving path of the finger 26 so that the finger 26 can be moved. Similar to the first ink sheet cassette 6, the second ink sheet cassette 10 is moved toward the printing portion along the normal path by the guide of a guide projection 13 formed on the bottom surface of the second ink sheet cassette 10 similar to the guide projection 13 of the first ink sheet cassette 6, and a groove formed on the second cassette guide plate 37.

Figure 3:
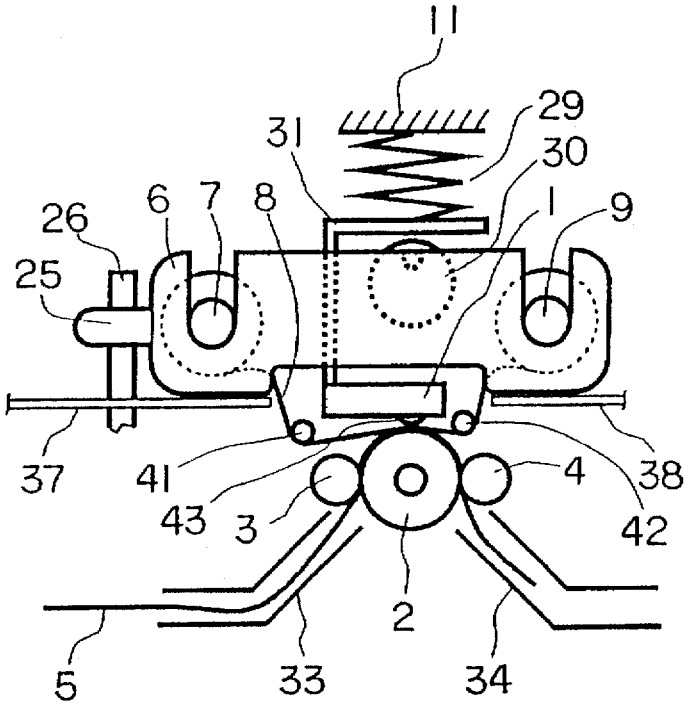
FIG. 3 is a view of a printing portion of the thermal transfer printing apparatus of the present invention.

FIG. 3 shows the actual printing state by using the desired ink sheet with the central printing portion. In case printing is executed by using the first ink sheet cassette 6 including the ink sheet 8, for example, the thermal head 1 is lifted so as to enable the first ink sheet cassette 6 to pass between the thermal head 1 and the platen roller 2. The first ink sheet cassette 6 is then moved on the platen roller 2 by the movement of the first carriage 14, and then the thermal head 1 is lowered. The tension bars 41 and 42 are moved down at the same time of the down movement of the thermal head 1 so as to apply a tension to the ink sheet 8 in order to press out the wrinkles of the ink sheet 8. In case that the ink sheet 8 is formed of four color portions of yellow Y, Hagenta M, Cyan C and Black BK as shown in FIG. 7, the ink sheet 8 is positioned so that the leading end of the portion of yellow Y is arranged on the platen roller 2. When the thermal head 1 is lowered, it is stopped temporarily at a position where a small gap is formed between the ink sheet 8 and the platen roller 2. The recording paper 5 is passed through a transfer path 33 at the up-stream side and inserted between the platen roller 2 and a pinch roller 3. The recording paper 5 is then passed through a gap formed between the ink sheet 8 and the platen roller 2, inserted between the platen roller 2 and a pinch roller 4, and moved through a transfer path 34 at the down-stream side, and vice versa.

When the leading end of the recording paper 5 reaches the printing start position, the thermal head 1 is lowered further and pressed with the predetermined pressure by the lead spring 29 against the platen roller 2 so as to hold the ink sheet 8 and the recording paper 5 between the thermal head 1 and the platen roller 2. This is the print starting state. The thermal transfer printing to the recording paper is carried out successively when the beating elements 43 corresponding to the desired image data are energized while rotating the take-up side core 9 by the winding motor (not shown) and rotating the platen roller 2 in the clockwise direction. After the printing of one page has been completed, the thermal head 1 is elevated a little, the recording paper 5 is returned to the original print starting position, and then the ink sheet 8 is fed so that the leading end of the portion of the next color, that is, magenta M is positioned on the platen roller 2. After that, the thermal head 1 is pressed again and the printing is repeated for every color. After the entire printing has been finished, the thermal head 1 is elevated to the top position. Then, the carriage motor 19 is rotated, and the first carriage 14 is moved toward the first stock portion by the rotation of the lead screw 35 to restore the first ink sheet cassette 6.

Figure 4:
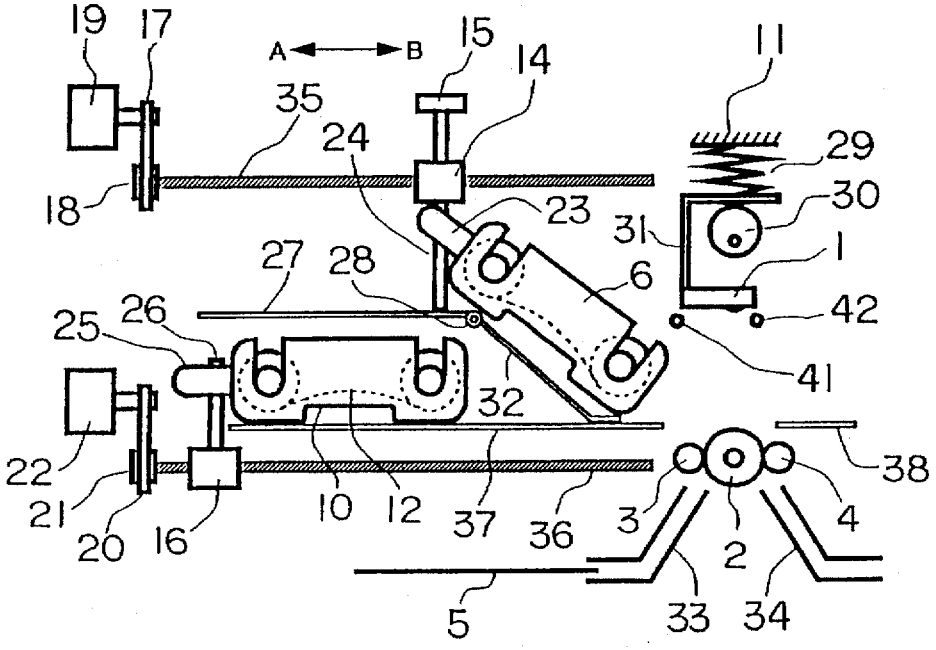
FIG. 4 is a view of an intermediate state of the take out motion of the first ink sheet cassette of the thermal transfer printing apparatus of the present invention.

Next, the ink sheet cassette interchanging operations will be explained in detail hereunder. FIG. 4 shows the intermediate state of the take out operation of the first ink sheet cassette 6. In FIG. 4, by the rotation of the carriage motor 19 the lead screw 35 is rotated and the first carriage 14 is moved in the direction of an arrow B, so that the first ink sheet cassette 6 is also moved in the direction of the arrow B on the first cassette guide plate 27 and then lowered along the slope of a door 32. The door 32 is rotatable around a hinge 28, and the free end of the door 32 is urged against the lower second cassette guide plate 37 by its own weight and a light tension spring (not shown).

Figure 5:
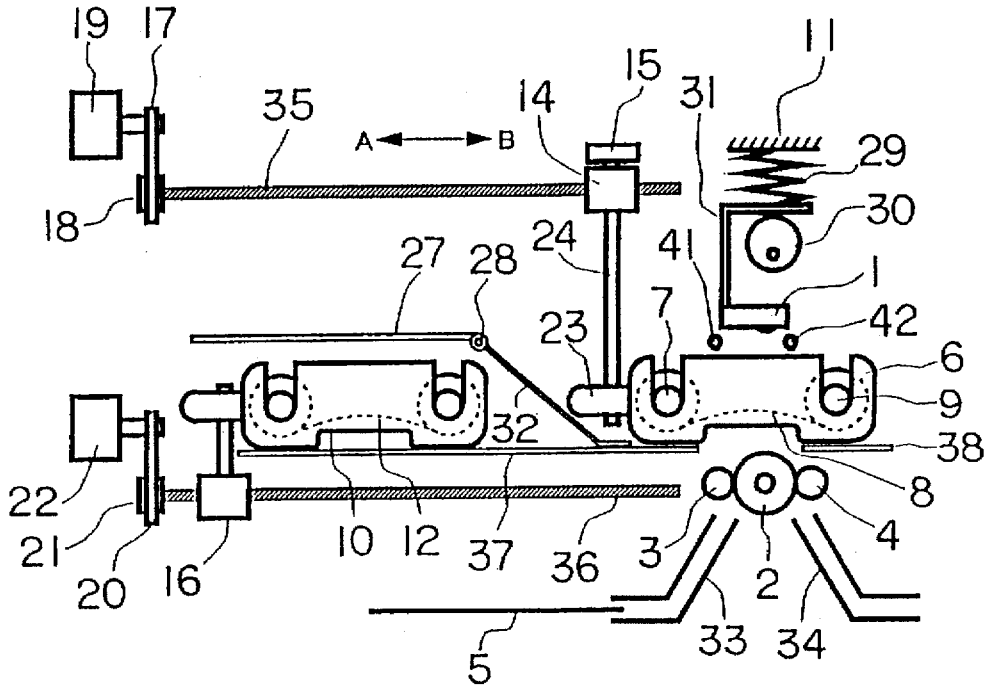
FIG. 5 is a view of a transfer completion state of the first ink sheet cassette of the thermal transfer printing apparatus of the present invention.

When the first carriage 14 is moved further in the direction of the arrow B, the first ink sheet cassette 6 is passed completely across the slope of the door 32 and positioned at the predetermined position of the printing portion as shown in FIG. 5. In this movement, the tip end of the finger 24 is lowered while sliding on the door 32 and finally reaches the lower limit determined by a stopper 15 attached to the top of the finger 24. After that, the ink sheet transfer mechanism (not shown) is connected to the supply side core 7 and the take-up side core 9 of the first ink sheet 8.

Figure 6:
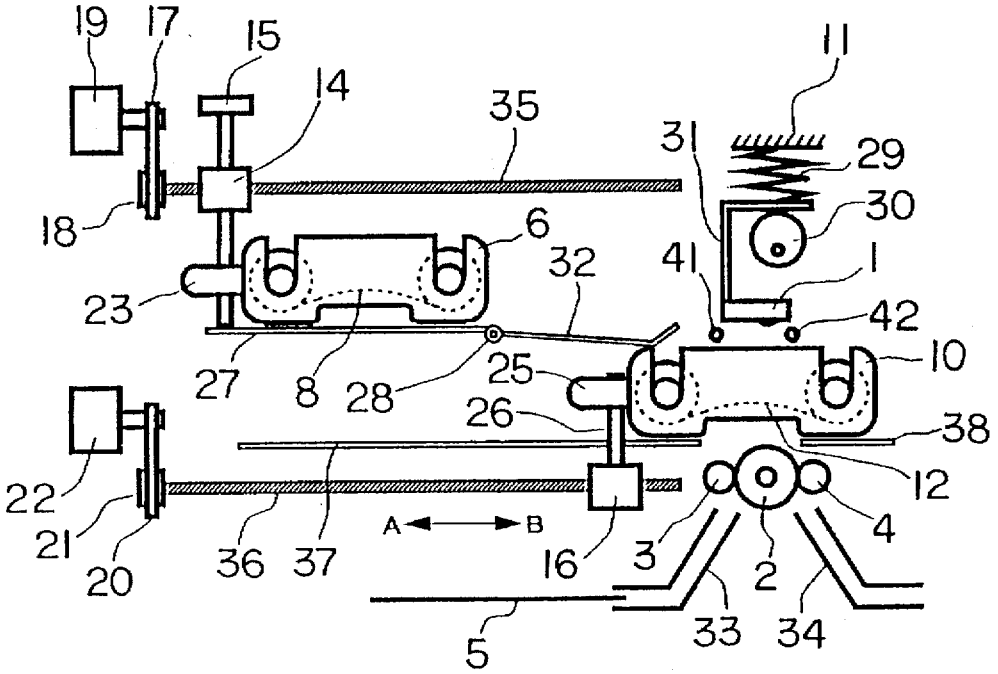
FIG. 6 is a view of a transfer completion state of the second ink sheet cassette of the thermal transfer printing apparatus of the present invention.

In case the first ink sheet cassette 6 is restored in the first stock portion after the predetermined printing operation at the printing portion has been completed, it is enough to move the first carriage 14 in the direction of the arrow A by reversing the rotary direction of the carriage motor 19 or the lead screw 35. In case that the second ink sheet cassette 10 is transferred to the printing portion, the lead screw 36 is rotated by the carriage motor 22 so that the second carriage 16 is moved in the direction of the arrow B. Thus, the ink sheet cassette 10 is moved in the direction of the arrow B on the second cassette guide plate 37, and finally moved to the printing portion while moving up the door 32. FIG. 6 shows a state in which the second ink sheet cassette 10 is positioned at the printing portion. In this state, the arrangement of the printing portion is determined so that the free end of the door 32 is beneath the upper surface of the second ink sheet cassette 10.

Accordingly, when the second ink sheet cassette is restored in the second stock portion by moving it in the direction of the arrow A, the door 32 does not disturb the movement. Specifically, when the second carriage 16 is moved in the direction of the arrow A by rotating the lead screw 36 in the reverse direction by the carriage motor 22, the second ink sheet cassette 10 is moved in the direction of arrow A, and the restoration of the second ink sheet cassette 10 to the second stock portion is completed. Thus, both of the fusion type and sublimation type thermal transfer printings can be used and many modes of the thermal transfer printings can be executed by using the combination of the first ink sheet cassette 6 including the first ink sheet 8 and the second ink sheet cassette 10 including the second ink sheet 12.

As stated above, according to the above-mentioned embodiment of the present invention, the thermal transfer printing apparatus comprises a thermal head including a plurality of heating elements, a platen roller to which the thermal head is urged selectively, a printing portion at which an ink on the ink sheet is printed by a thermal energy produced when the heating elements are conducted on a recording paper inserted between the thermal head and the platen roller, a first stock portion for storing therein a first ink sheet cassette including a first ink sheet, a second stock portion for storing therein a second ink sheet cassette including a second ink sheet, and means for transferring to the printing portion selectively one of the first ink sheet cassette and the second ink sheet cassette to carry out the thermal transfer printing. Accordingly, a thermal transfer printing apparatus inexpensive and small in size can be obtained. In this apparatus, the ink sheet can be handled easily and a plurality of ink sheets can be interchanged with small power.

The other embodiment of the present invention will be explained with reference to FIGS. 10–14. Parts of the apparatus which are similar to corresponding parts of the apparatus of said embodiment have been given corresponding reference numerals and need not be further redescribed.

Figure 10:
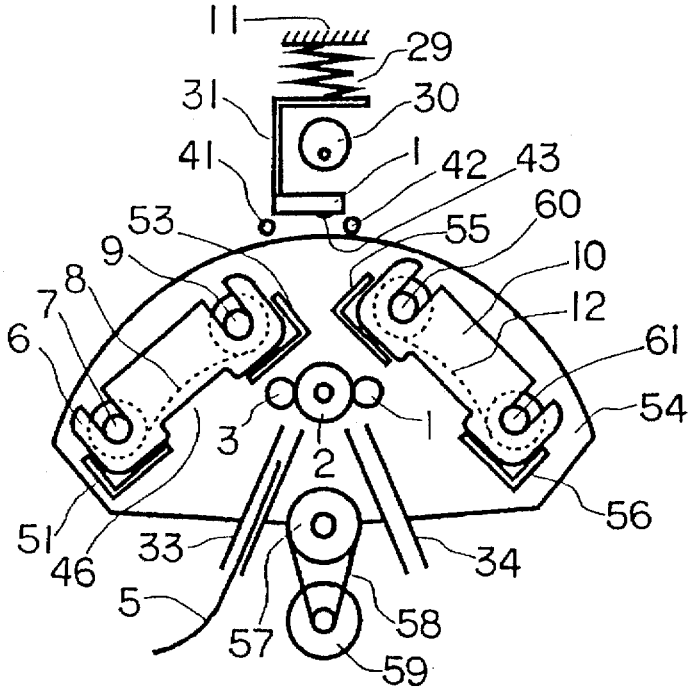
FIG. 10 is a schematic view of the thermal transfer printing apparatus according to the other embodiment of the present invention.
Figure 14:
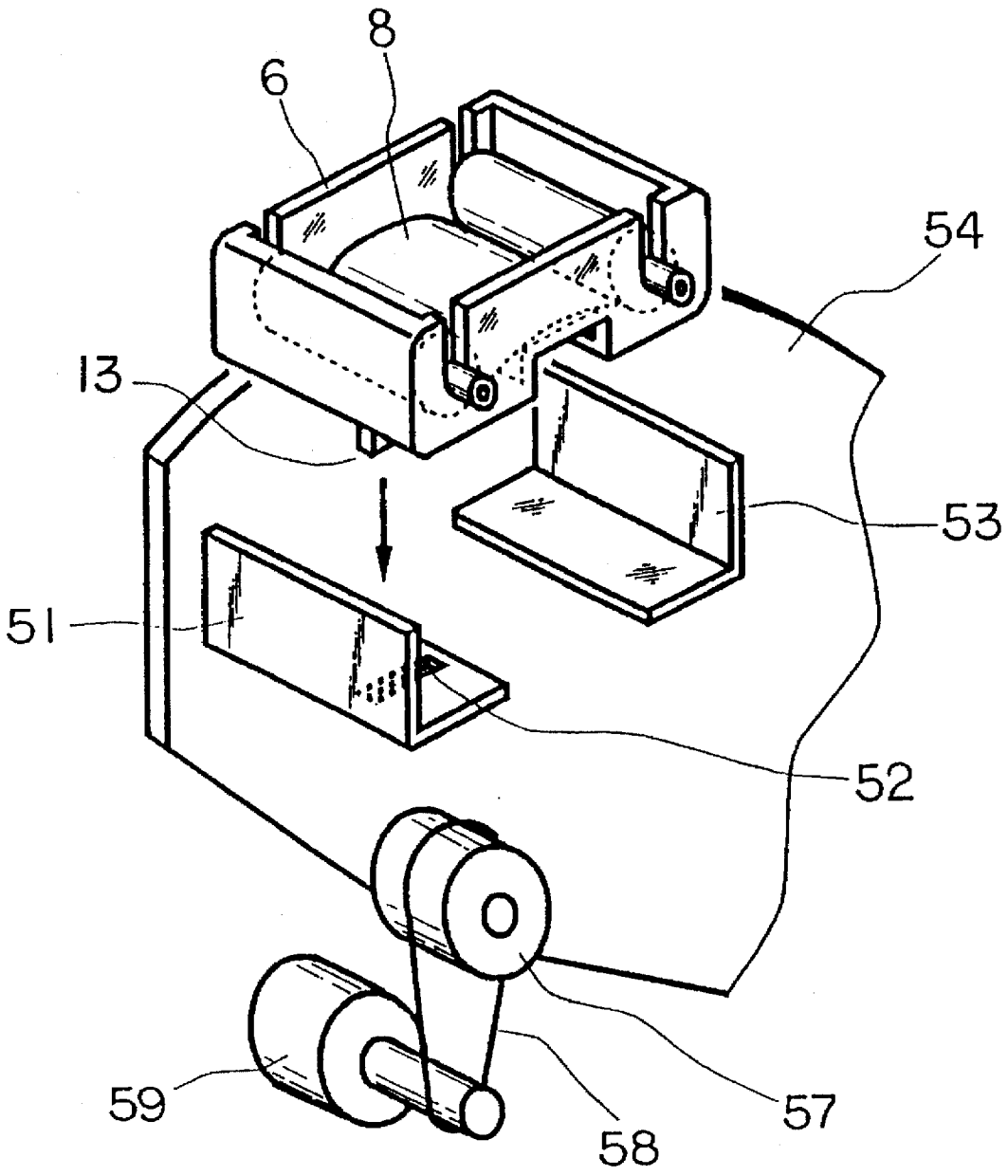
FIG. 14 is a schematic perspective view of the thermal transfer printing apparatus showing the state that the first ink sheet cassette is mounted in the first stock portion according to the other embodiment of the present invention.

As shown in FIGS. 10 and 14, first cassette supporting plates 51 and 53 are mounted on a rotary plate 54 so that cassette supporting surfaces thereof are arranged normal substantially to a plane of the rotary plate 54.

As shown in FIG. 14, a hole 52 into which the projection 13 is inserted for fixing is provided on the first cassette supporting plate 51. The first ink sheet cassette 6 is mounted between the first cassette supporting plates 51 and 53 so that the supply side core 7 and the take-up side core 9 of the first ink sheet cassette 6 are arranged normal substantially to the plane of the rotary plate 54. Similarly, second cassette supporting plates 55 and 56 are mounted on the rotary plate 54 so that the second ink sheet cassette 10 is arranged similar to the first ink sheet cassette 6.

A pulley 57 having teeth of predetermined pitch on the outer periphery thereof is fixed as a unit on a part of the rotary plate 54". The rotary plate 54 is rotated by a drive motor 59 through a timing belt 58 trained around the pulley 57. It is possible to use a stepping motor having a basic step angle of 1.8 degree as the drive motor 59. When the drive motor 59 is rotated in the counter-clockwise direction by a predetermined angle, the rotary plate 54 is rotated from a position shown in FIG. 10 to a position shown in FIG. 12, so that the second ink sheet cassette 10 is moved and positioned at the printing portion. After that, a supply side core 60 and a take-up side core 61 of the second ink sheet cassette 10 are connected to an ink sheet transfer mechanism (not shown). The thermal transfer printing using the second ink sheet 12 will be explained as follows.

Figure 11:
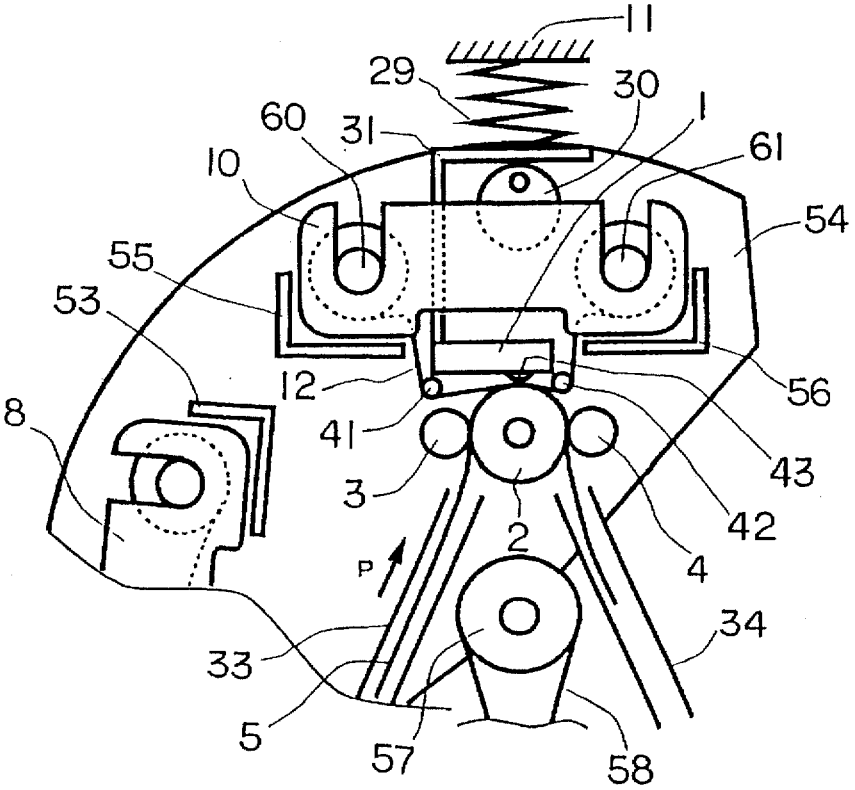
FIG. 11 is a view of a printing potion of the thermal transfer printing apparatus according to the other embodiment of the present invention.
Figure 12:
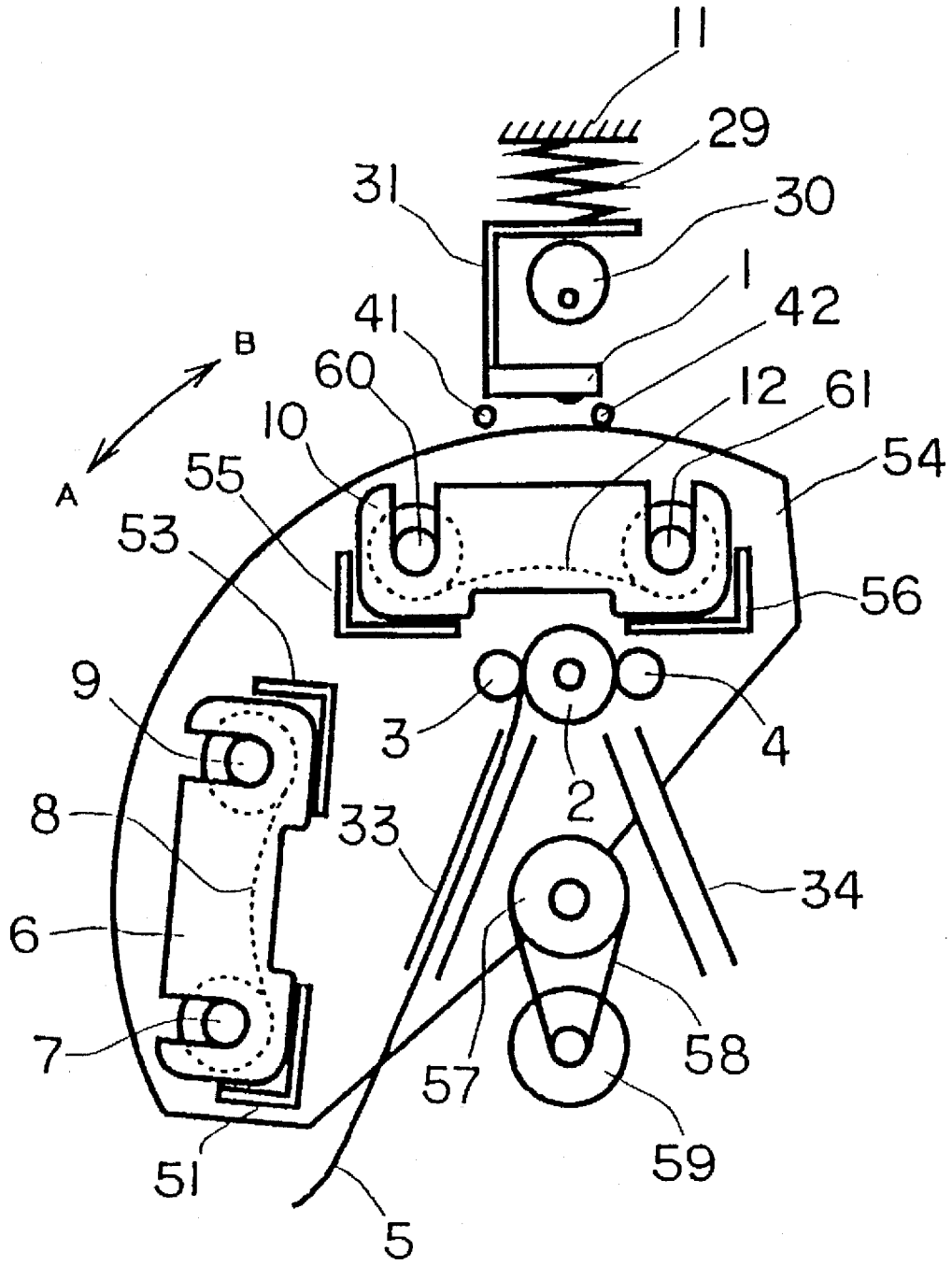
FIG. 12 is a view of a transfer completion state of the second ink sheet cassette of the thermal transfer printing apparatus according to the other embodiment of the present invention.

FIG. 11 shows the actual printing state by using the desired ink sheet with the central printing portion. In case that the printing is executed by using the second ink sheet cassette 10 including the ink sheet 12, for example, the thermal head 1 is lifted so as to enable the second ink sheet cassette 10 to pass between the thermal head 1 and the platen roller 2. The second ink sheet cassette 10 then is moved on the platen roller 2 by the movement of the rotary plate 54, and then the thermal head 1 is lowered. The tension bars 41 and 42 are moved down at the same time of the down movement of the thermal head 1 so as to apply a tension to the ink sheet 2 in order to press out the wrinkles of the ink sheet In case that the ink sheet 12 is formed of four color portions of yellow Y, magenta M, cyan C and black BK as shown in FIG. 7, the ink sheet is positioned so that the leading end of the portion of yellow Y is arranged on the platen roller When the thermal head 1 is lowered, it is stopped temporarily at a position where a small gap is formed between the ink sheet 12 and the platen roller 2. The recording paper 5 then is passed through the transfer path 33 at the up-stream side and inserted between the platen roller 2 and the pinch roller 3. The recording paper 5 is then passed through a gap formed between the ink sheet 12 and the platen roller 2, inserted between the platen roller 2 and the pinch roller 4, and moved through the transfer path 34 at the down-stream side, and vice versa.

When the leading end of the recording paper 5 reaches the printing start position, the thermal head 1 is lowered further and pressed with the predetermined pressure by the head spring 29 against the platen roller 2 so as to hold the ink sheet 12 and the recording paper 5 between the thermal head 1 and the platen roller 2. This is the print starting state. The thermal transfer printing to the recording paper is carried out successively when the heating elements 43 corresponding to the desired image data are energized while rotating the take-up side core 61 by the winding motor (not shown) and rotating the platen roller 2 in the clockwise direction. After the printing of one page has been completed, the thermal head 1 is elevated a little, the recording paper 5 is returned to the original print starting position, and then the ink sheet 12 is fed so that the leading end of the portion of the next color, that is, magenta M is positioned on the platen roller 2. After that, the thermal head 1 is pressed again and the printing is repeated for every color.

Figure 13:
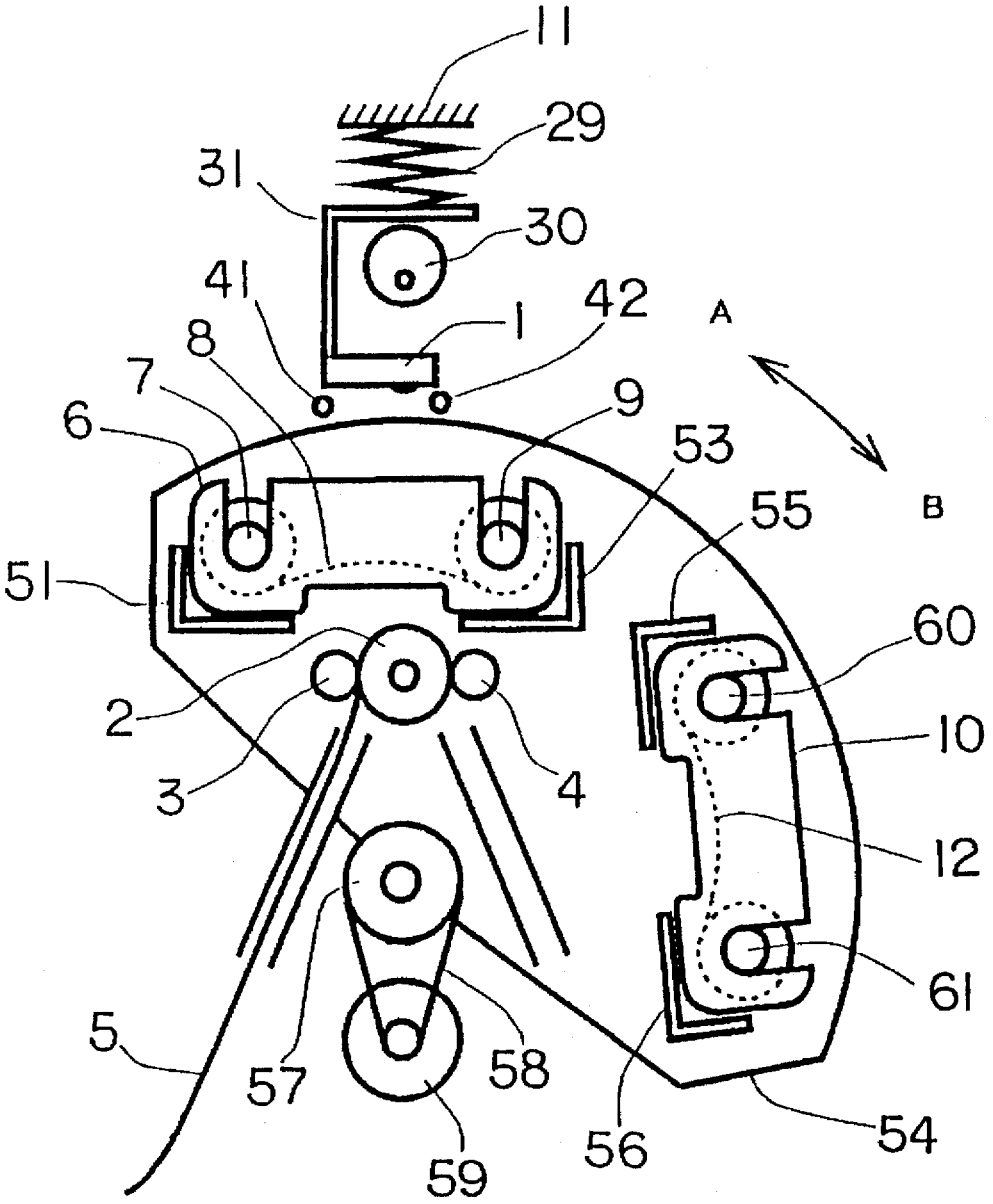
FIG. 13 is a view of a transfer completion state of the first ink sheet cassette of the thermal transfer printing apparatus according to the other embodiment of the present invention.

After the printing using the second ink sheet 12 has been finished, the thermal head 1 is elevated to the top position. At the same time, the connection between the ink sheet transfer mechanism (not shown) and the supply side core 60 and the take-up side core 61 is released. When the rotary plate 54 is rotated by a predetermined angle from the state shown in FIG. 12 in the direction of arrow B by rotating the drive motor 59 in the clockwise direction, the first ink sheet cassette 6 is fed to the printing portion as shown in FIG. 13, so that the thermal transfer printing using the first ink sheet 8 can be carried out. The details of the printing operations using the first ink sheet are the same with the printing operations using the second ink sheet 12. Accordingly, the first ink sheet cassette 6 including the first ink sheet 8 and the second ink sheet cassette 10 including the second ink sheet 12 can be selectively transferred quickly to the printing portion by merely rotating the rotary plate 54 in the directions of arrow A and arrow B. As explained above, both of the fusion type and sublimation type thermal transfer printings can be used and many modes of the thermal transfer printings can be executed by using the combination of the first ink sheet cassette 6 including the first ink sheet 8 and the second ink sheet cassette 10 including the second ink sheet 12.

As stated above, according to the above-mentioned embodiment of the present invention, the thermal transfer printing apparatus comprises a thermal head including a plurality of heating elements, a platen roller to which the thermal head is urged selectively, a printing portion at which an ink on the ink sheet is printed by a thermal energy produced when the heating elements are conducted on a recording paper inserted between the thermal head and said platen roller, a plurality of ink sheet cassettes each including an ink sheet, a rotating plate which can be rotated at a predetermined angular position, means for mounting the plurality of ink sheet cassettes normal to the rotating plate and transferring to the printing portion selectively one ink sheet cassette including the desired ink sheet by rotating and positioning the rotating plate to carry out the thermal transfer printing.

According to this embodiment a thermal transfer printing apparatus can be made small in size and low in cost. According to the thermal transfer printing apparatus, the handling of the ink sheet is easy and the ink sheet can be interchanged quickly.

What is claimed is:

1. A thermal transfer printing apparatus comprising: a thermal head including a plurality of heating elements, a platen roller to which said thermal head is urged selectively, a printing portion at which an ink on art ink sheet is printed on a recording paper by a thermal energy produced when said heating elements are energized, said recording paper being inserted between said thermal head and said platen roller, a first stock portion for storing therein a first ink sheet cassette including a first ink sheet, a second stock portion for storing therein a second ink sheet cassette including a second ink sheet, and means for transferring to said printing portion selectively one of said first ink sheet cassette and said second ink sheet cassette to carry out the thermal transfer printing, wherein said means for transferring causes the entire selected cassette to move as a unit into the priming portion, wherein both said first and second stock portions are arranged at one of art up-stream side and a down-stream side of art ink sheet cassette forwarding direction with respect to said printing portion and stacked one above the other such that said first stock portion is permanently located above said second stock portion.

2. A thermal transfer priming apparatus comprising: a thermal head including a plurality of heating elements, a platen roller to which said thermal head is urged selectively, a printing portion at which an ink on an ink sheet is printed on a recording paper by a thermal energy produced when said heating elements are energized, said recording paper being inserted between said thermal head and said platen roller, a first stock portion for storing therein a first ink sheet cassette including a first ink sheet, a second stock portion for storing therein a second ink sheet cassette including a second ink sheet, and means for transferring to said printing portion selectively one of said first ink sheet cassette and said second ink sheet cassette to carry out the thermal transfer printing, said means for transferring being capable of transferring one of the cassettes as a unit while the other cassette remains stationary.

3. A thermal transfer printing apparatus comprising: a thermal head including a plurality of heating elements, a platen roller to which said thermal head is urged selectively, a printing portion at which an ink on an ink sheet is printed on a recording paper by a thermal energy produced when said heating elements are energized, said recording paper being inserted between said thermal head and said platen roller, a plurality of ink sheet cassettes each including an ink sheet, a rotating plate which can be rotated at a predetermined angular position about an axis of rotation thereof, means for mounting said plurality of ink sheet cassettes normal to said rotating plate, wherein, when compared to the axis of rotation of the rotating plate, the platen roller is disposed radially inwardly with respect to the printing head so as to be positioned radially between an outer periphery of the rotating plate and the axis of rotation, and means for driving the rotating plate to rotate so as to transfer to said printing portion selectively one ink sheet cassette including a desired ink sheet, the selected ink sheet cassette remaining stationary relative to the rotating plate during the ink sheet cassette transfer operation.

4. A thermal transfer printing apparatus comprising: a thermal head including a plurality of heating elements, a platen roller to which said thermal head is urged selectively, a printing portion at which an ink on an ink sheet is printed on a recording paper by a thermal energy produced when said heating elements are energized, said recording paper being inserted between said thermal head and said platen roller, a first stock portion for storing therein a first ink sheet cassette including a first ink sheet, a second stock portion for storing therein a second ink sheet cassette including a second ink sheet, and means for transferring to said printing portion selectively one of said first ink sheet cassette and said second ink sheet cassette to carry out the thermal transfer printing, wherein a handle having a through hole is provided on an outer portion of said ink sheet cassette, and a finger is provided on said ink sheet cassette transferring means, said finger being inserted into said handle so that the ink sheet cassette is transferred by movement of said finger.

5. A thermal transfer printing apparatus comprising: a thermal head including a plurality of heating elements, a platen roller to which said thermal head is urged selectively, a printing portion at which an ink on an ink sheet is printed on a recording paper by a thermal energy produced when said heating elements are energized, said recording paper being inserted between said thermal head and said platen roller, a first stock portion for storing therein a first ink sheet cassette including a first ink sheet, a second stock portion for storing therein a second ink sheet cassette including a second ink sheet, and means for transferring to said printing portion selectively one of said first ink sheet cassette and said second ink sheet cassette to carry out the thermal transfer printing, wherein both said first and second stock portions are arranged at one of an up-stream side and a down-stream side of an ink sheet cassette forwarding direction with respect to said printing portion and stacked one above the other, wherein a handle having a through hole is provided on an outer portion of said ink sheet cassette, and a finger is provided on said ink sheet cassette transferring means, said finger being inserted into said handle so that the ink sheet cassette is transferred by movement of said finger.

6. A thermal transfer priming apparatus comprising: a thermal head including a plurality of heating elements, a platen roller to which said thermal head is urged selectively, a printing portion at which an ink on an ink sheet is printed on a recording paper by a thermal energy produced when said heating elements are energized, said recording paper being inserted between said thermal head and said platen roller, a first stock portion for storing therein a first ink sheet cassette including a first ink sheet, a second stock portion for storing therein a second ink sheet cassette including a second ink sheet, and means for transferring to said printing portion selectively one of said first ink sheet cassette and said second ink sheet cassette to carry out the thermal transfer printing, wherein both said first and second stock portions are arranged at one of an up-stream side and a down-stream side of an ink sheet cassette forwarding direction with respect to said printing portion and stacked one above the other, wherein an upper ink sheet cassette is supported by a guide plate having a rotatable door and is transferred along a slope of said door to said printing portion, and: when a lower ink sheet cassette is transferred to said printing portion, said door is pushed up by said lower ink sheet cassette.

* * * * *